US005207341A

United States Patent [19]

Yeager

[11] Patent Number: 5,207,341

[45] Date of Patent: May 4, 1993

[54] TAMPER EVIDENT WIDE MOUTH CONTAINER AND LID

[76] Inventor: Don F. Yeager, 2532 Brentwood Cir., Lenoir, N.C. 28645

[21] Appl. No.: 876,158

[22] Filed: Apr. 30, 1992

[51] Int. Cl.[5] ..... B65D 41/04

[52] U.S. Cl. ..... 215/334; 215/329; 215/354; 215/246; 215/252; 215/341; 215/258; 220/288; 220/304

[58] Field of Search ..... 215/329, 334, 354, 246, 215/252, 258, 307, 341; 220/304, 288

[56] References Cited

U.S. PATENT DOCUMENTS

| | | | |
|---|---|---|---|
| 3,721,361 | 3/1973 | Barry et al. | 215/354 X |
| 4,114,779 | 9/1978 | Stoll, III | 220/288 |
| 4,456,137 | 6/1984 | Lyman | 215/307 X |
| 4,538,740 | 9/1985 | Peterson, Jr. | 215/252 X |
| 4,711,365 | 12/1987 | Fomby | 215/329 X |
| 4,724,973 | 2/1988 | Shah | 215/246 |
| 4,874,102 | 10/1989 | Jessop et al. | 215/354 X |

*Primary Examiner*—Allan N. Shoap
*Assistant Examiner*—Paul A. Schwarz
*Attorney, Agent, or Firm*—Browdy and Neimark

[57] ABSTRACT

A bottle for packaging beverages for individual use, comprising a wide mouth container and a closure lid; the container having a neck with a circular opening; the closure lid having a concentric inner skirt and outer skirt; the container and the closure lid having corresponding fastening means for opening and closing the container; the corresponding fastening means respectively located on an inner circumferential area of the circular opening of the neck and on an outer circumference of the inner skirt; the outer circumferential area of the neck being smooth; the outer diameter of the neck being equal to the inner diameter of the outer skirt, wherein the outer skirt covers and protects the smooth outer circumferential area of the neck when the closure lid is fastened to the container, the environment outside the bottle.

7 Claims, 3 Drawing Sheets

TAMPER EVIDENT WIDE MOUTH CONTAINER AND LID

BACKGROUND OF THE INVENTION

The present invention relates to bottles or cans having wide mouth containers and corresponding closures suitable for the storage and delivery of carbonated or uncarbonated liquids. More specifically, the invention is directed to a bottle or can having a blow-molded plastic wide mouthed storage container having internal threads on its neck which correspond with a special closure lid having internal and external concentric walls or skirts. The use of internal threads provides a smooth drinking surface on the outside of the container. The inner skirt is threaded on its outer surface to correspond to the threads on the neck of the container, while the outer skirt protectively covers the drinking surface of the container prior to use.

The bottle also has a variety of other features which combine to enhance its novel utility, such as internal seals, tamper evident over-packaging, venting notches in the internal threads to relieve pressure in the container before full removal of the closure, and a large width in relation to height to provide stability.

Prior art devices relevant to the claimed invention include the U.S. Pat. No. 4,410,097 to Kusz which discloses a child-resistant plastic container made up of an internally threaded container and which extends over the rim and partially down the outside of the container. However, the outside "skirt" on the closure lid does not correspond with a smooth surface to provide a sanitary drinking surface as provided by the claimed invention.

The U.S. Pat. No. 3,707,241 to Taylor discloses a blow molded plastic container and closure which are threaded in the conventional manner, with a flange which extends into the mouth of the container for reinforcement.

Greck 4,706,836 shows an internally threaded drum for containing toxic materials which utilizes an externally threaded plug. A separate over cap is mounted over the total structure.

The ancient patent to Gross 937,238 and the relatively old patent to McGinnis 2,417,510 disclose interiorly threaded containers which mate with exteriorly threaded caps. Gross utilizes a gasket to improve the sealing properties of this cap and container.

The patents to Van Vlijmen 1,702,182; Law 3,269,576; and Morris 4,103,797 all show container (with mating closures) which are both internally and externally threaded.

Lepore 3,147,876 and Kennedy 4,648,519 are representative of many references which disclose vented closures.

None of the disclosed prior art is directed to a combination of novel features which results in the unique aspects of the claimed invention including the general concept of an internally threaded wide mouthed container with a corresponding externally threaded closure skirt with a labyrinth seal.

Thus, in the Kusz patent the internal threads are provided to create a locking feature and do not provide the result intended by this invention.

U.S. Pat. Nos. 1,702,182, 3,269,576 and 4,103,797 have both inside and outside threads which preclude their use for the purpose intended by this invention.

SUMMARY OF THE INVENTION

The invention is especially directed to a bottle or can for one time consumption of its contents by an individual, rather than a large content intended for a multiplicity of servings. However, the bottle or can may be enlarged to provide multiple servings The bottle has a relatively large diameter in relation to its height so that there is a great deal of stability when the container is placed upright. Since it is very possible that this bottle might be used for energy enhancing athletic type drinks, it is necessary that its stability on a table or shelf be firm since it could be subject to abuse in use by ungainly hands, and gloved or mittened or taped hands.

The large diameter relative to height is also direct to small children without experience and/or coordination. While the invention is directed to one time consumption, it is not so limited in light of the exceptional seal provided by the labyrinth sealing system of the invention. The container is optionally transparent. There are some advantages in the marketplace for this optional feature. If it is not required, then an opaque container can also be used.

The wide mouthed bottle is defined by any bottle or can having a container whose neck opening has a diameter substantially equal to the diameter of the container wall. The wide mouth feature provides a more suitable dispensing container than a narrow mouthed container or a container with a small hole. The mouth on other such containers minimizes the amount of air that can enter a bottle. As a result, a vacuum is created and has to be relieved before more liquid can flow. A wide mouthed container, as described, allows air to enter above the drinking surface providing a free flowing liquid retrieval.

This invention improves on the typical wide mouthed container in that a typical sealable container usually has screw threads on the outside of the container. These threads enter the mouth when drinking from the container, and as a result contribute to dripping and/or drooling while drinking. This invention provides a wide mouthed container with threads on the inside of the mouth instead of the outside, with a closure with two parallel downward extended walls with threads on the outside of the inner wall corresponding to those on the inside of the container neck. Thus, the container is pleasant to drink from and eliminates dripping or drooling.

In addition to the anti-drip feature, the smooth outer neck of the container is covered by the outer wall of the closure and therefore remains protected from contamination and the hostile environments to which these containers will be subjected. This provides for a sanitary drinking edge that is not obtainable in most containers (i.e. metal cans or coated cardboard boxes).

It is necessary that the sealing surfaces vent to atmosphere quickly after the first release so that any pressure build up in the container will bleed off before the closure is disengaged from the container. This prevents hazardous situations where the closure could become a projectile when the closure lid is disengaged while under pressure. The invention therefore provides a plurality of venting notches through the threads of the container to relieve the internal pressure that is built up by certain liquids or gases. This pressure is relieved after the first fractional release of the closure lid and before the closure lid is fully removed. These venting notches also assist in a more even flow of the liquid through the threads instead of dripping or splashing over the threads.

In order to store a liquid as mentioned above, it is necessary that the combination of container and closure lid provide a seal to the atmosphere that will withstand positive or negative inside container pressure. Without a perfect contact thread line, such a thread would not be able to hold a pressure or a vacuum. As part of a novel sealing labyrinth, the invention provides a lower ring below the threads in the container. This ring engages with the inner wall of the closure to form a continuous seal against pressure or vacuum. The angle of the seal ring on the container wall is determined by the required function (i.e. pressure, vacuum, etc.). An increase or decrease in internal pressure will increase the sealing force between the seal ring and the closure. This is a distinct benefit to such liquids as carbonated soft drinks which can reach internal pressures as high as 120 psi.

The novel sealing labyrinth also includes secondary seals in combination with the previously mentioned seal ring. Each seal by itself provides some or all of the sealing necessary, but in combination they provide a synergistic seal or labyrinth seal. A labyrinth seal consisting of two or more seals is much stronger than any individual seal.

A first embodiment of the secondary seal is created by a wedge-like resilient fit between the top of the closure lid and the inside and outside of the top of the container. Another embodiment of the secondary seal can be a semi-vertical flexing ring in the top of the closure. This ring will provide constant pressure and a positive seal as the top of the container engages against it. Different applications of the container will vary the requirements for sealing, thus creating an alternative or intermix of the final seal or seals.

The invention also includes tamper evidence means. This is achieved by shrink wrapping a sleeve over the filled and engaged closure and container. To achieve absolute tamper evidence, the invention provides indentations on the closure and retaining lugs on the container so that the shrink wrap sleeve is trapped in the indentations and on the lugs, thereby precluding rotation on the closure.

The retaining lugs are located just below the closure rim. With both the closure and the container indented and/or lugged with both engaged by the same shrink wrap sleeve, it is not possible to remove the closure without tearing the sleeve which discloses tampering. It is preferred that the shrink wrap sleeve be perforated in the area between the container lugs and the bottom of the closure. The container lugs may be replaced by a bottle with irregular or flat sides which also will act as part of the tamper evidence means. Irregular sides or flat sides can be additionally beneficial because any regular flat sided container will hold more liquid with less volume than any circular shaped container having an equivalent inner diameter. With a smaller surface area per volume contained, there is significant shipping and sales space economy in the marketplace.

The novel container can be easily manufactured by injection molding the closure of an impermeable material. The threads can be unscrewed from a mold in a conventional manner. If possible, they could also be stripped in a mold conventionally. The container can be made by injection mold with the bottle threads as part of a preform. Subsequently the bottle is formed to shape by standard blow mold, stretch blowing, or similar technologies. These techniques are well known to those practicing in the field and not part of the invention.

The combination of described features such as wide mouth, sanitary drinking surface, labyrinth seals which function in cooperation, venting, anti-drip, a tamper evident sleeve, resealability, recyclable and total packaging concept result in a new and unique bottle or can.

BRIEF DESCRIPTION OF THE DRAWINGS

The foregoing and additional objects, features and advantages of the present invention will become more apparent to those skilled in the art from consideration of the accompanying detailed description of preferred embodiments thereof, taken in conjunction with the accompanying drawings, in which.

DETAILED DESCRIPTION OF THE PREFERRED EMBODIMENTS OF THE INVENTION

Figure 1:
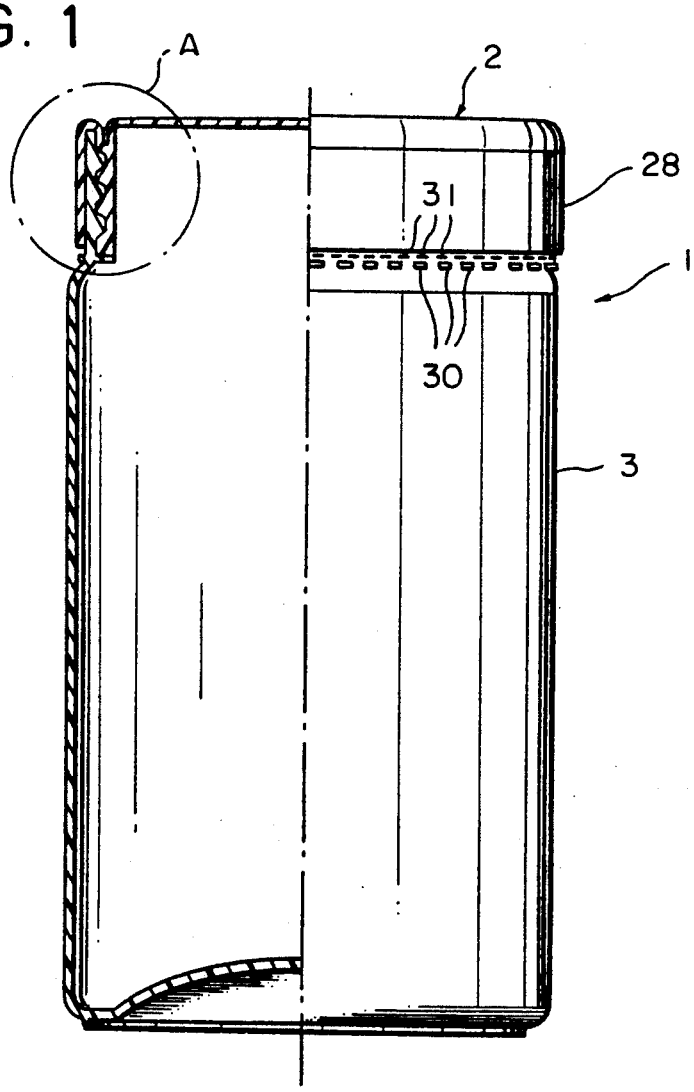
FIG. 1 shows one-half of a side elevation view and one-half of a vertical sectional view of an all-plastic container body and a corresponding plastic lid.
Figure 4:
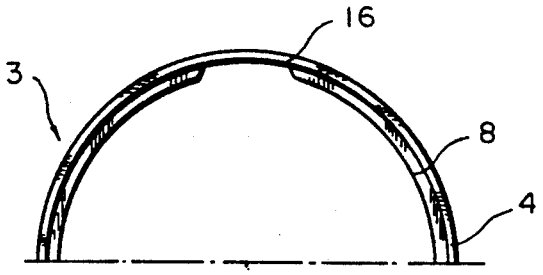
FIG. 4 shows a partial top of FIG. 3 showing the thread vents.

FIG. 1 shows a bottle or can 1 having a closure lid 2 and a container 3. Container 3 is injection blow molded with polyethylene terephthalate (PET) or other plastic resin to provide necessary physical and barrier properties as required for specific applications. While the preferred material is PET, the container 3 is not limited to plastic and can be made of materials such as glass.

Figure 2:
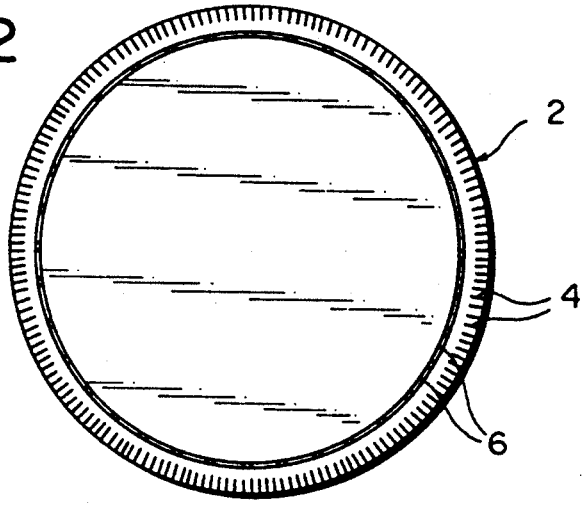
FIG. 2 shows a top view of closure lid of the all-plastic bottle or can of FIG. 1.

FIG. 2 shows the closure lid 2 corresponding to bottle 3 having a plurality of indentations 4 around the circumference of the lid 2. Indentations 4 are a conventional means for assisting in the opening and closing of the closure lid 2 on bottle 3. Indentations 4 also assist in preventing rotation of a shrink wrap sleeve 28 around closure lid 2, as discussed further below.

Figure 3:
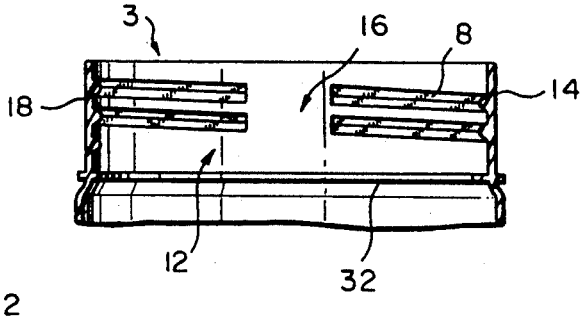
FIG. 3 shows a partial cross sectional side view of the top portion of the container showing the thread vents.

FIG. 3 shows threads 8 which correspond to threads 10 of the closure lid 2. Threads 8 are located on the interior surface 12 of neck 14 of bottle 3. At least two threads 8 are provided on the interior surface 12 at conventional spacing.

In most applications, a multiplicity of venting notches 16 through the threads 8 will permit the relief of internal pressures before the closure lid 2 is fully removed.

It is understood that vent notches similar to vent notches 16 can be provided in threads 10 either together with vent notches 16 or alone.

Figure 5:
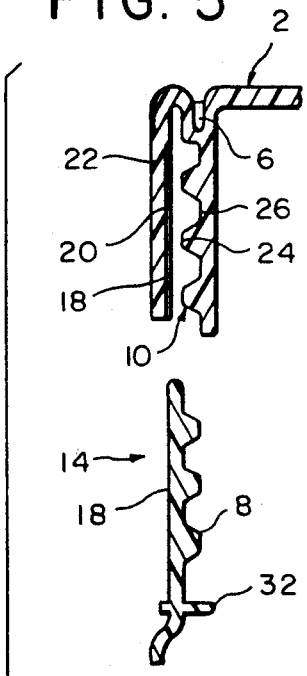
FIG. 5 shows a partial enlarged cross sectional side view of circled portion "A" of FIG. 1.

As shown in FIG. 5, the location of thread 8 on the interior surface 12 of neck 14 provides a smooth exterior drinking surface 18 on neck 14.

FIG. 5 also shows the details of closure lid 2. Lid 2 is made from PET or other suitable plastic to provide the necessary physical and barrier properties as required for specific applications.

Figure 6:
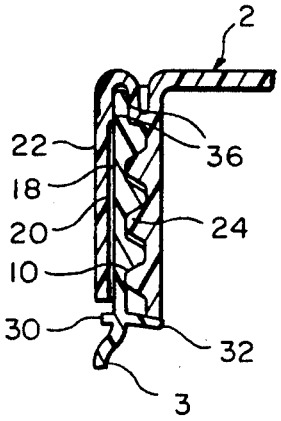
FIG. 6 is an exploded view of FIG. 5.

Closure lid 2 has two concentric vertical skirts 22 and 24. As shown in FIG. 6 the inner surface 20 of outer skirt 22 provides a protective covering over smooth exterior drinking surface 18. Outer skirt 22 also provides strength and rigidity to the bottle 1. In addition, outer skirt 20 provides the ability to create a labyrinth seal as discussed further below.

Inner skirt 24 carries threads 10 corresponding to threads 8 on closure lid 2 on outer surface 26 of skirt 24. As noted above, vents similar to vent notches 16 can be provided through threads 10 if considered desirable. As shown in FIG. 6, the outside diameter of the closure 2 and container 3 are substantially equal so as to give the impression of one continuous surface.

Further, the inner diameter of neck 14 is substantially equal to the inner diameter of container 1 so as to create the wide-mouth aspect important to the use of the bottle by individuals engaged in athletic or other strenuous events. Also, the outer diameter of neck 14 is made equal to the inner diameter of outer skirt 22, to maintain drinking surface 18 in a sanitary condition by providing no access to the environment outside the bottle. While the above diameters are equal, closure lid 2 is made so that it will rotate on container 3.

The smooth exterior drinking surface 18 is additionally protected to provide a sanitary surface by use of a tamper evident shrink wrap sleeve 28 shown in FIG. 2. The shrink wrap sleeve 28 also provides a convenient location for advertising and other information, in addition to decorative designs to enhance the appearance of bottle 1. Rotation of the shrink wrap sleeve 28 on bottle 1 is precluded by indentations 4 on closure lid 2 and plurality of lugs 30 spaced around the circumference of neck 14. As shown, lugs 30 are located immediately below closure lid 2 when bottle 1 is closed. In operation, lugs 30 and indentations 4 trap and engage the shrink wrap sleeve on the closed bottle precluding rotation of the shrink wrap on the bottle. Perforations 31 are shown between lugs 30 and the bottom of closure lid 2 to facilitate removal of lid 2.

FIGS. 3, 5 and 6 show a primary lower seal 32 as an internal ring integrally formed below threads 8 on interior surface 12 of neck 14. Lower seal 32 is designed to flex as the bottom of inner skirt 24 moves downward on the way to closing closure lid 2 on container 3. Lower seal 32 is substantially perpendicular to interior surface 12 of neck 14 prior to closing lid 2. However, seal 32 can be either angled slightly up or down depending on the required pressure or vacuum placed on bottle 1 when closed.

Figure 8:
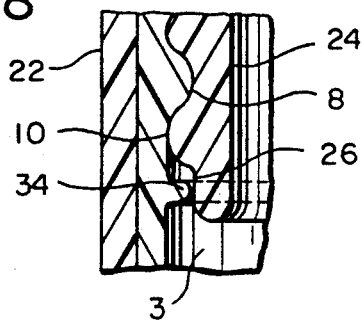
FIG. 8 shows a partial enlarged cross sectional side view of another embodiment of the lower seal between the closure lid and the container.

FIG. 8 shows a different lower seal 34 which serves the same purpose as seal 32. Seal 34, however, has an inner diameter that permits inner skirt 24 to pass downward while moving to close lid 2, while outer surface 26 maintains frictional engagement with seal 34.

FIG. 6 shows an upper seal 36 formed by a wedge-like interference fit between the top of neck 14 and the junction between inner skirt 24 and outer skirt 22 when lid 2 is engaged in container 3. Upper seal 36 is shown formed by both sides of neck 14 each side of which is engaged respectively to inner skirt 24 and outer skirt 22 thus creating a second and third seal when considering seal 32 or 34 as a first seal.

Figure 7:
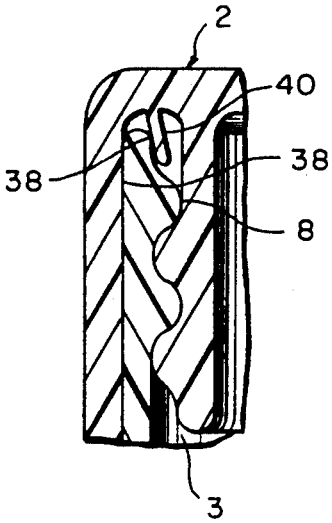
FIG. 7 shows a partial enlarged cross sectional side view of another embodiment of the upper seal between the closure lid and the container.

FIG. 7 shows a different upper seal 38 which serves the same purpose as upper seal 36 inner but engages as a flexing ring. Upper seal 38 is formed by 38 rather than inner skirt 24 an angled flexing ring 40 located in the junction between inner skirt 24 and outer skirt 22 and the upper portion of neck 14 when lid 2 is engaged to container 3.

Figure 9:
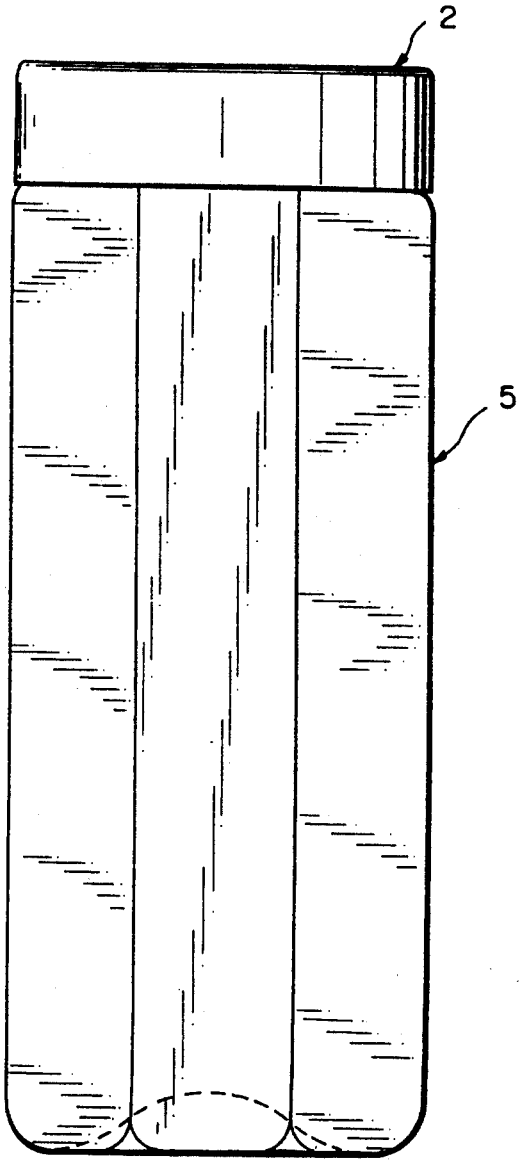
FIG. 9 shows a side view of another embodiment of the all-plastic bottle or can.
Figure 10:
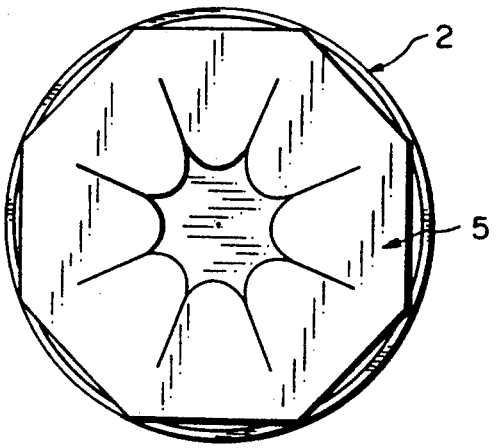
FIG. 10 shows a bottom view of the embodiment of FIG. 9.

FIGS. 9 and 10 show another embodiment of the invention as bottle 5. Bottle 5 has all the above described features but has a container that has flat sides rather than a round cross section. Such container 5 will hold a greater volume than a circular container of equal height and inner diameter. Container 5 will also eliminate the need for lugs 30 for maintaining shrink wrap 30 trapped on the container. Container 5 is especially useful for storage of solid materials such as tennis bells.

The foregoing description of the specific embodiments will so fully reveal the general nature of the invention that others can, by applying current knowledge, readily modify and/or adapt for various applications such specific embodiments without departing from the generic concept, and, therefore, such adaptation and modifications should and are intended to be comprehended within the meaning and range of equivalents of the disclosed embodiments. It is to be understood that the phraseology or terminology employed herein is for the purpose of description and not of limitation.

What is claimed is:

1. A bottle for packaging beverages for individual use, comprising:

a wide mouth container;

a closure lid;

said container and said closure lid having corresponding fastening means for opening and closing said container;

said container having a neck with a circular opening;

said neck having a first outer wall extending up vertically from said container over a length to a rim curving inward into said circular opening from an upper end of said first outer wall;

said closure lid having a top, an inner skirt and an outer skirt;

said inner skirt and said outer skirt being concentric;

said outer skirt having a first inner wall extending down vertically from said top substantially over a length equal to said length of said first outer wall of said neck;

said corresponding fastening means respectively located on a second inner wall of said circular opening of said neck and on a second outer wall of said inner skirt;

an outer diameter of said neck being the same and substantially equal to an inner diameter of said outer skirt over said length of said first inner wall of said outer skirt;

wherein said first inner wall of said outer skirt covers and protects said first outer wall of said neck when said closure lid is fastened to said container from the environment outside the bottle and said first outer wall of said neck provides a smooth drinking surface;

a first sealing means located on said neck near a juncture between said neck and said container for increasing sealing contact between said closure lid and said container;

a second and third sealing means located near a juncture between said inner skirt and said outer skirt for further increasing sealing contact between said closure lid and said container;

said first sealing means comprising a first resilient integral flange formed below said fastening means on said second inner wall of said circular opening of said neck, said first resilient integral flange frictionally engaged to said inner skirt when said bottle is closed; and said second and third sealing means comprising a free end of said neck frictionally engaged between said first inner wall and said second outer wall when said bottle is closed.

2. The bottle according to claim 1, wherein an inner diameter of said neck is substantially equal to an inner diameter of said container.

3. The bottle according to claim 1, wherein said second and third sealing means comprises said free end of said neck frictionally engaged on and between said first inner wall and a downwardly extending second resilient integral flange having an end integrally secured at a juncture between said inner skirt and said outer skirt.

4. The bottle according to claim 1, wherein a free end of said inner skirt is below a free end of said first resilient integral flange when said closure lid and said container are completely fastened.

5. The bottle according to claim 1, wherein said free end of said inner skirt is frictionally engaged to said first resilient integral flange when said closure lid and said container are completely fastened.

6. The bottle according to claim 1, further comprising venting means formed on said fastening means for relieving pressure in said container when said closure lid is opened.

7. The bottle according to claim 1, further comprising, tamper evident means engaged to said container and said closure lid for revealing the opening of said bottle, said tamper evident means comprising: a shrink wrap sleeve covering said closure lid and an upper portion of said container, said shrink wrap sleeve engaged to indentations on said closure lid and lugs on said upper portion of said container, said shrink wrap sleeve having a perforated area between said lugs and a free end of said outer skirt and around said closure lid.

* * * * *